US005765997A

United States Patent [19]

You

[11] Patent Number: 5,765,997

[45] Date of Patent: Jun. 16, 1998

[54] BUBBLE GENERATOR FOR A WASHING MACHINE

[75] Inventor: Hae-Sang You, Incheon, Rep. of Korea

[73] Assignee: Daewoo Electronics Co., Ltd., Seoul, Rep. of Korea

[21] Appl. No.: 596,440

[22] Filed: Feb. 2, 1996

[30] Foreign Application Priority Data

Apr. 29, 1995 [KR] Rep. of Korea ..... 95-9055
Apr. 29, 1995 [KR] Rep. of Korea ..... 95-9056

[51] Int. Cl.[6] ..... F04B 39/00

[52] U.S. Cl. ..... 417/312; 417/413.1; 181/227

[58] Field of Search ..... 417/312, 413.1, 417/472, 473; 181/227, 268, 275, 403

[56] References Cited

U.S. PATENT DOCUMENTS

| | | | |
|---|---|---|---|
| 3,171,506 | 3/1965 | Hald | 181/403 |
| 3,700,069 | 10/1972 | Rausch | 181/227 |
| 4,294,330 | 10/1981 | Baldwin et al. | 181/275 |
| 4,923,035 | 5/1990 | Keller | 181/268 |
| 4,924,966 | 5/1990 | Kanda et al. | 181/268 |
| 5,137,432 | 8/1992 | Tsai | 417/312 |
| 5,164,552 | 11/1992 | Pandeya et al. | 181/403 |
| 5,205,719 | 4/1993 | Childs et al. | 181/403 |
| 5,232,353 | 8/1993 | Grant | 417/413.1 |

FOREIGN PATENT DOCUMENTS

| | | | |
|---|---|---|---|
| 2039613 | 8/1980 | United Kingdom | 417/312 |

*Primary Examiner*—Timothy Thorpe
*Assistant Examiner*—Peter G. Kurytnyk
*Attorney, Agent, or Firm*—Beveridge, DeGrandi, Weilacher & Young LLP

[57] ABSTRACT

A bubble generator includes a body with an inlet passage and outlet passages. Pumping means which comprises a pair of bellows, a plurality of first check plates, a plurality of second check plates, a pair of permanent magnets and a pair of electromagnets are disposed between the inlet passage and the outlet passages for pressurizing the air that flows through the inlet passage into the bellows and discharges it through the outlet passages. Noise-reducing means which comprises a first pipe having the same inner diameter as that of the outlet passage, a second pipe disposed concentrically with and in the first pipe, and a plurality of ribs supporting the second pipe at the first pipe are disposed in the middle of the outlet passages, for reducing noises caused by the pressurized air which is periodically pressurized by the pumping means and discharged into the outlet passages, by dispersing the pressurized air inside the outlet passages.

2 Claims, 8 Drawing Sheets

BUBBLE GENERATOR FOR A WASHING MACHINE

BACKGROUND OF THE INVENTION

1. Field of the Invention

The present invention relates to a bubble generator for a washing machine, and more particularly to a bubble generator which is used in a so-called air-bubble washing machine designed to supply air bubbles into the washing tub in the course of washing process to increase cleaning efficiency.

2. Prior Art

Generally, a bubble generator for a washing machine is an apparatus which is provided to a so-called air-bubble washing machine and generates air bubbles to supply into a washing tub of the washing machine in the course of washing operation to increase cleaning efficiency. A first embodiment of the conventional bubble generator for a washing machine is illustrated in FIGS. 1 to 4.

According to FIGS. 1 to 4, the first embodiment of the conventional bubble generator for a washing machine includes a body 10, bellows 30*a* and 30*b*, operation plates 40*a* and 40*b*, permanent magnets 50*a* and 50*b*, and electromagnets 60*a* and 60*b*.

Bellows 30*a* and 30*b* are respectively attached to upper and lower sides of body 10 to keep air from leaking between outer surface of body 10 and bellows 30*a* and 30*b*. An inlet passage 11 and outlet passages 12*a* and 12*b* are formed in body 10. Inlet passage 11 is communicated with insides of bellows 30*a* and 30*b* through first through holes 13*a* and 13*b*, and outlet passages 12*a* and 12*b* are also respectively communicated with the insides of bellows 30*a* and 30*b* through second through holes 14*a* and 14*b*. First through holes 13*a* and 13*b* are open and shut by first check plates 15*a* and 15*b* attached to outer surface of body 10, and second through holes 14*a* and 14*b* are also open and shut by second check plates 16*a* and 16*b* attached to inner surfaces of outlet passages 12*a* and 12*b* of body 10. Brackets 17*a* and 17*b* are respectively provided for upper and lower sides of body 10 near outlet passages 12*a* and 12*b*.

Each of the ends of operation plates 40*a* and 40*b* usually made of resilient materials are respectively mounted on brackets 17*a* and 17*b*, and permanent magnets 50*a* and 50*b* are provided for the other ends of operation plates 40*a* and 40*b*. Electromagnets 60*a* and 60*b* are disposed respectively spaced apart from permanent magnets 50*a* and 50*b*. Electromagnets 60*a* and 60*b* and permanent magnets 50*a* and 50*b* are disposed with respect to one another in such a manner that permanent magnets 50*a* and 50*b* move in opposite directions with respect to each other when electromagnets 60*a* and 60*b* are magnetized. That is, electromagnets 60*a* and 60*b* and permanent magnets 50*a* and 50*b* are disposed with respect to one another in such a manner that permanent magnets 50*a* and 50*b* respectively move in directions indicated by arrows in FIG. 3 when electromagnets 60*a* and 60*b* are charged with electric currents of "+" direction and that permanent magnets 50*a* and 50*b* respectively move in directions indicated by arrows in FIG. 4 when electromagnets 60*a* and 60*b* are charged with electric currents of "−" direction.

Bellows 30*a* and 30*b* are respectively attached around the centers of operation plates 40*a* and 40*b*.

In the first embodiment of a conventional bubble generator for a washing machine constructed as above, when electromagnets 60*a* and 60*b* are charged with alternating currents, permanent magnets 50*a* and 50*b* vibrate in directions opposite to each other by electromagnetic interactions between electromagnets 60*a* and 60*b* and permanent magnets 50*a* and 50*b*. That is, when electromagnets 60*a* and 60*b* are charged with currents of "+" direction, permanent magnets 50*a* and 50*b* respectively move in directions indicated by the arrows in FIG. 3 and when electromagnets 60*a* and 60*b* are charged with currents of "−" direction, permanent magnets 50*a* and 50*b* respectively move in directions indicated by the arrows in FIG. 4.

If electromagnets 60*a* and 60*b* are charged with currents of "+" direction and permanent magnets 50*a* and 50*b* respectively move in directions indicated by the arrows in FIG. 3, operation plates 40*a* and 40*b* move away from body 10, and accordingly bellows 30*a* and 30*b* respectively attached around the centers of operation plates 40*a* and 40*b* are expanded. If bellows 30*a* and 30*b* are expanded, air pressure inside bellows 30*a* and 30*b* becomes lower than that inside inlet passage 11 and outlet passages 12*a* and 12*b*, so there occur pressure differences between insides of bellows 30*a* and 30*b* and insides of inlet passage 11 and outlet passages 12*a* and 12*b*. By these pressure differences, first check plates 15*a* and 15*b* which are attached to outer surface of body 10 and have been shutting first through holes 13*a* and 13*b* are pushed toward bellows 30*a* and 30*b*, first through holes 13*a* and 13*b* are open, and accordingly air outside the bubble generator, i.e., atmospheric air, flows into the insides of bellows 30*a* and 30*b*. At the same time, by the pressure differences, second check plates 16*a* and 16*b* attached to inner surfaces of outlet passages 12*a* and 12*b* are also pushed toward bellows 30*a* and 30*b*, second through holes 14*a* and 14*b* are shut, and accordingly air inside outlet passages 12*a* and 12*b* is prevented from flowing backward into the insides of bellows 30*a* and 30*b*.

Meanwhile, if electromagnets 60*a* and 60*b* are charged with currents of "−" direction with changes of the current direction and permanent magnets 50*a* and 50*b* respectively move in directions indicated by the arrows in FIG. 4, operation plates 40*a* and 40*b* move toward body 10, and accordingly the bellows 30*a* and 30*b* are compressed. If bellows 30*a* and 30*b* are compressed, the air pressure inside the bellows 30*a* and 30*b* becomes higher than that inside inlet passage 11 and outlet passages 12*a* and 12*b*, so there occur pressure differences between the insides of bellows 30*a* and 30*b* and the insides of inlet passage 11 and outlet passages 12*a* and 12*b*. By these pressure differences, first check plates 15*a* and 15*b* are pushed toward body 10, first through holes 13*a* and 13*b* are shut, and accordingly air inside bellows 30*a* and 30*b* is prevented from flowing backward into inlet passage 11. At the same time, by the pressure differences, second through holes 14*a* and 14*b* which have been shut by second check plates 16*a* and 16*b* are also open, and accordingly air inside bellows 30*a* and 30*b* is delivered with pressure into outlet passages 12*a* and 12*b*. The pressurized air delivered into outlet passages 12*a* and 12*b* is supplied into a washing tub (not shown) through bubble-supply lines which are not shown.

A series of such operation is continuously repeated as the directions of the alternating currents flowing through electromagnets 60*a* and 60*b* change, and according to this, air-bubbles are continuously supplied to the washing tub.

However, according to the first embodiment of a conventional bubble generator for the washing machine constructed as above, since the pressurized air runs through the insides of outlet passages 12*a* and 12*b* while periodically expanding, there is a problem that it makes great noises at the bubble generator.

FIGS. 5 and 6 illustrate a second embodiment of the conventional bubble generator which intends to reduce the noises caused by the periodical expansion of the pressurized air in the outlet passages 12*a* and 12*b* by way of forming expansion chambers 18*a* and 18*b* in the middle of outlet passages 12*a* and 12*b* and expanding the pressurized air in expansion chambers 18*a* and 18*b* in order to overcome the problem of such first embodiment of a conventional bubble generator for a washing machine.

According to FIGS. 5 and 6, construction and operation of the second embodiment of a conventional bubble generator are, as explicitly shown in the drawings, entirely identical to those of the first embodiment of a conventional bubble generator, except that expansion chambers 18*a* and 18*b* are formed in the middle of outlet passages 12*a* and 12*b* and the pressurized air running through outlet passages 12*a* and 12*b* is primarily expanded in expansion chambers 18*a* and 18*b*. Therefore, the applicant gives the same reference numbers to the corresponding parts of the second conventional embodiment with those of the first conventional embodiment and omits descriptions as to the construction and the operation of the second embodiment of a conventional bubble generator.

According to the second embodiment of a conventional bubble generator for a washing machine constructed as above, the noises occurring in outlet passage 12*a* and 12*b* can be somewhat reduced compared with the conventional first embodiment, but noises caused by collisions of the air which is rapidly expanding in expansion chambers 18*a* and 18*b* with inner walls of expansion chambers 18*a* and 18*b* still exist.

SUMMARY OF THE INVENTION

Accordingly, an object of the present invention is to overcome the above-described problem of a conventional bubble generator for a washing machine, and is to provide an improved bubble generator for a washing machine which remarkably reduces noises caused by periodical expansions of pressurized air which are generated when the air compressed by bellows of a bubble generator runs through the outlet passages.

To achieve the above object, the present invention provides a bubble generator for a washing machine comprising a body with an inlet passage and outlet passages; a pumping means disposed between the inlet passage and the outlet passages for pressurizing the air that flows through the inlet passage into the pumping means and discharging it through the outlet passages; and a noise-reducing means disposed in the middle of the outlet passages, for reducing noises caused by the pressurized air which is periodically pressurized by the pumping means and discharged into the outlet passages, by dispersing the pressurized air inside the outlet passages.

It is preferable that the pumping means comprises a plurality of bellows of which insides are communicated with the inlet passage through first through holes formed at one end of the inlet passage of the body and are also communicated with the outlet passages through second through holes formed at each end of the outlet passages; one or more first check plates attached to outer surface of the body for opening or shutting the first through holes as the bellows are expanded or contracted; one or more second check plates attached to inner surfaces of the outlet passages of the body for shutting or opening the second through holes as the bellows are expanded or contracted; and a vibration-generating means with a plurality of permanent magnets and a plurality of electromagnets for periodically expanding or contracting the bellows as the electromagnets are charged with alternating currents.

And it is also preferable that the noise-reducing means comprises a first pipe having the same inner diameter as that of the outlet passage, a second pipe disposed concentrically with and in the first pipe, and a plurality of ribs supporting the second pipe at the first pipe.

According to the bubble generator for a washing machine of the present invention constructed as above, the air pressurized by the pumping means is periodically discharged into the outlet passages through the second through holes. The pressurized air that has been discharged into the outlet passages flows through flow passages divided into several sections by the first pipe, the second pipe, and a plurality of ribs of the noise-reducing means. The pressurized air that flows into the noise-reducing means expands inside the respective section of the flow passages.

Therefore, according to the bubble generator for a washing machine of the present invention, since the pressurized air that has been discharged into the outlet passages expands inside the respective section of the flow passages of the noise-reducing means, noises generated by the bubble generator can be considerably reduced compared with the prior-art bubble generators in which the air that flows into the outlet passages entirely expands only in the outlet passages.

Also, to achieve the above object, the present invention provides a bubble generator for a washing machine comprising a body with an inlet passage and outlet passages; a pumping means disposed between the inlet passage and the outlet passages for pressurizing the air flows through the inlet passage into the pumping means and discharging it through the outlet passages; and a noise-reducing means including a plurality of expansion chambers formed in the middle of the outlet passages and a plurality of sound-absorbing plates disposed in the expansion chambers, having a plurality of through holes and made of sound absorbing materials, for reducing noises caused by the pressurized air which is periodically pressurized by the pumping means and discharged into the outlet passages, by firstly expanding the pressurized air in the expansion chambers and secondly dispersing the pressurized air through the through holes formed at the sound-absorbing plates.

It is preferable that the pumping means comprises a plurality of bellows of which insides are communicated with the inlet passage through first through holes formed at one end of the inlet passage of the body and are also communicated with the outlet passages through second through holes formed at each end of the outlet passages; one or more first check plates attached to outer surface of the body for opening or shutting the first through holes as the bellows are expanded or contracted; one or more second check plates attached to inner surfaces of the outlet passages of the body for shutting or opening the second through holes as the bellows are expanded or contracted; and a vibration-generating means with a plurality of permanent magnets and a plurality of electromagnets for periodically expanding or contracting the bellows as the electromagnets are charged with alternating currents.

According to the bubble generator for a washing machine of the present invention constructed as above, the pressurized air that has been discharged through the second through holes into the outlet passages by the pumping means firstly expands in the expansion chambers provided in the middle of the outlet passages and thereafter disperses through a plurality of through holes formed in the sound-absorbing plates made of sound-absorbing materials and provided inside the expansion chambers.

Therefore, according to the bubble generator for a washing machine of the present invention constructed as above, since the pressurized air that has been discharged into the outlet passages firstly expands inside the expansion chambers provided in the middle of the outlet passages and thereafter expands with dispersing through a plurality of through holes formed in the sound-absorbing plate, noises generated by the bubble generator can be considerably reduced compared with the prior-art bubble generators in which the air that flows into the outlet passages entirely expands in the outlet passages or in the outlet passages and the expansion chambers.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Figure 1:
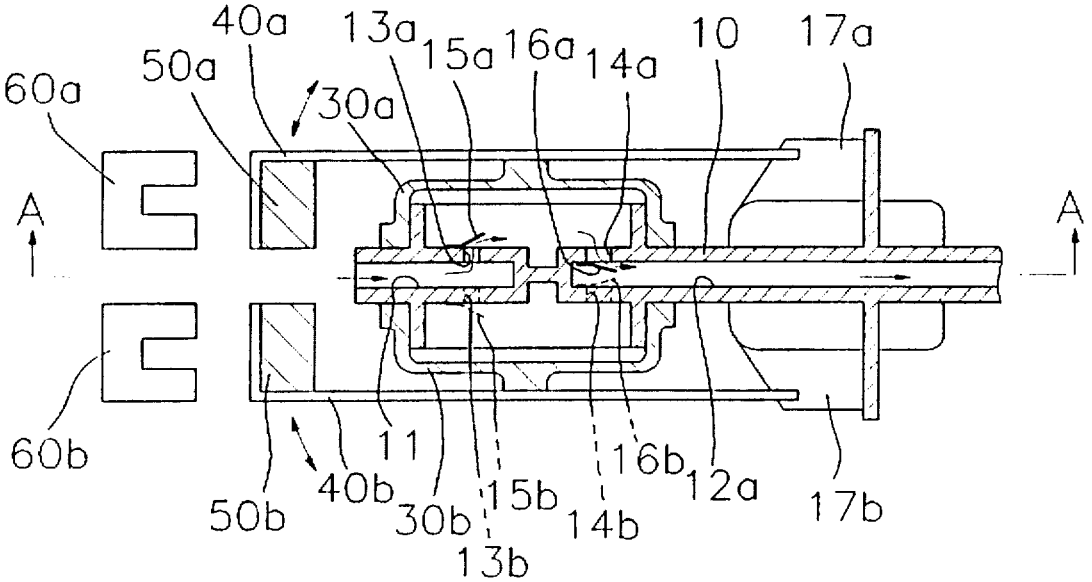
FIG. 1 is a front sectional view of a first embodiment of a conventional bubble generator for a washing machine.
Figure 2:
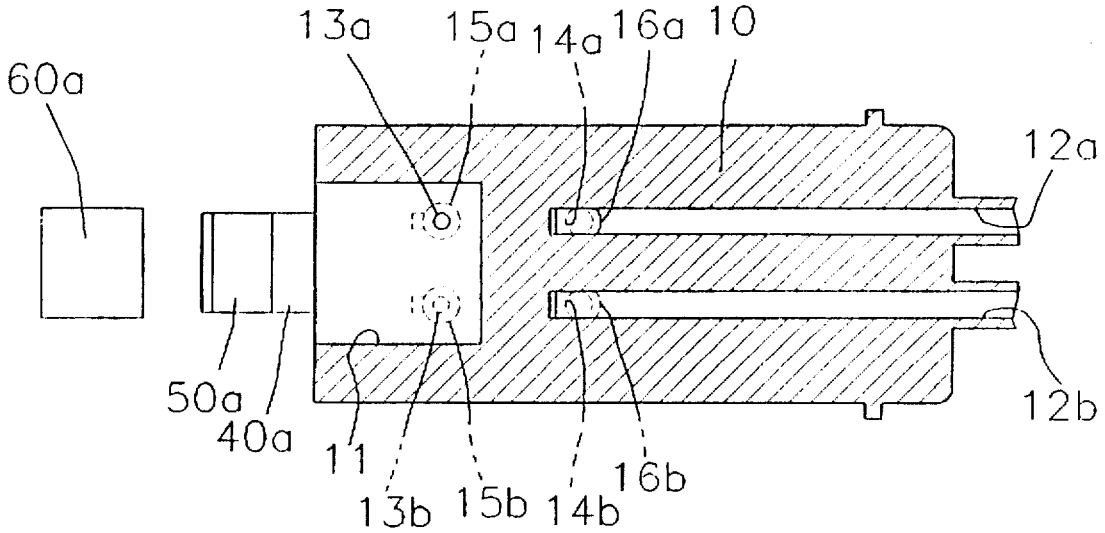
FIG. 2 is a sectional view taken along line A—A in FIG. 1.
Figure 3:
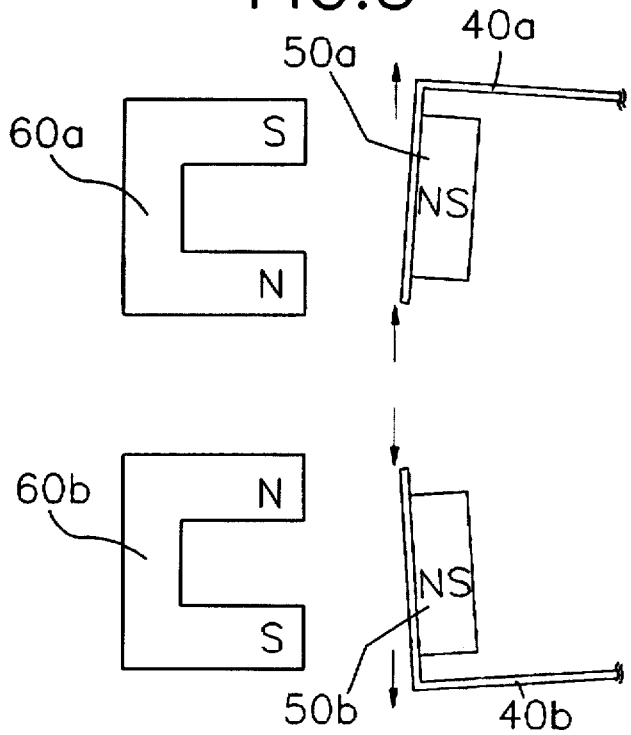
FIG. 3 is a view for explaining polarities of electromagnets and moving directions of permanent magnets when the electromagnets of the conventional bubble generator for a washing machine are charged with electric currents of "+" direction.
Figure 4:
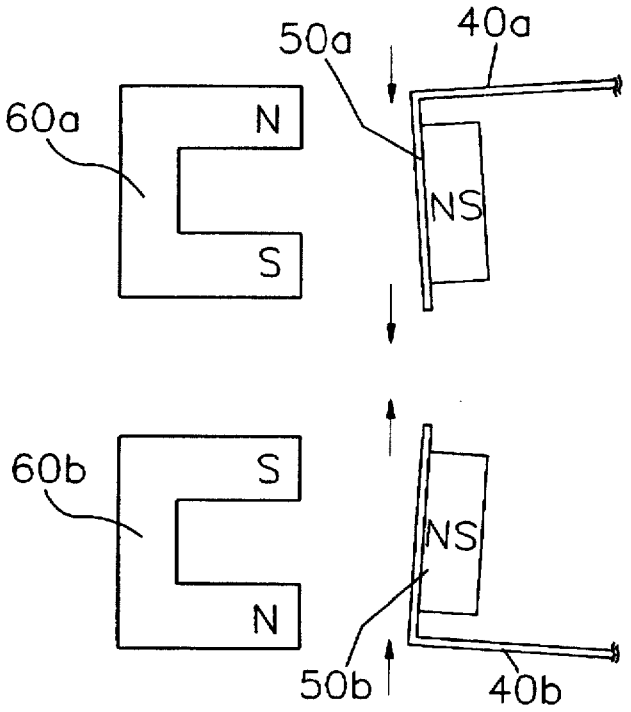
FIG. 4 is a view for explaining polarities of electromagnets and moving directions of permanent magnets when the electromagnets of the conventional bubble generator for a washing machine are charged with electric currents of "–" direction.
Figure 5:
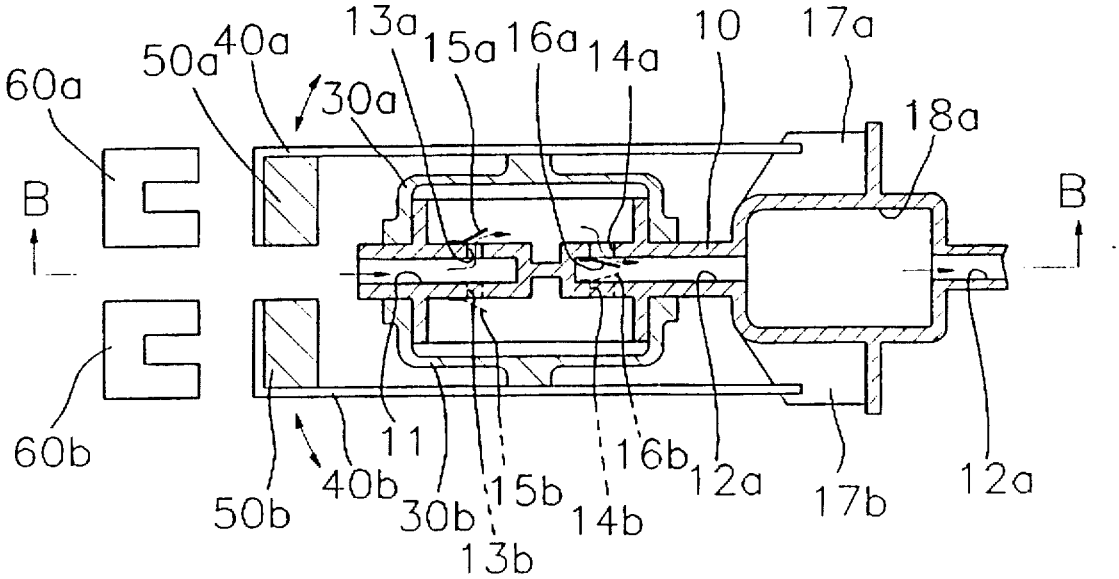
FIG. 5 is a front sectional view of a second embodiment of the conventional bubble generator for a washing machine.
Figure 6:
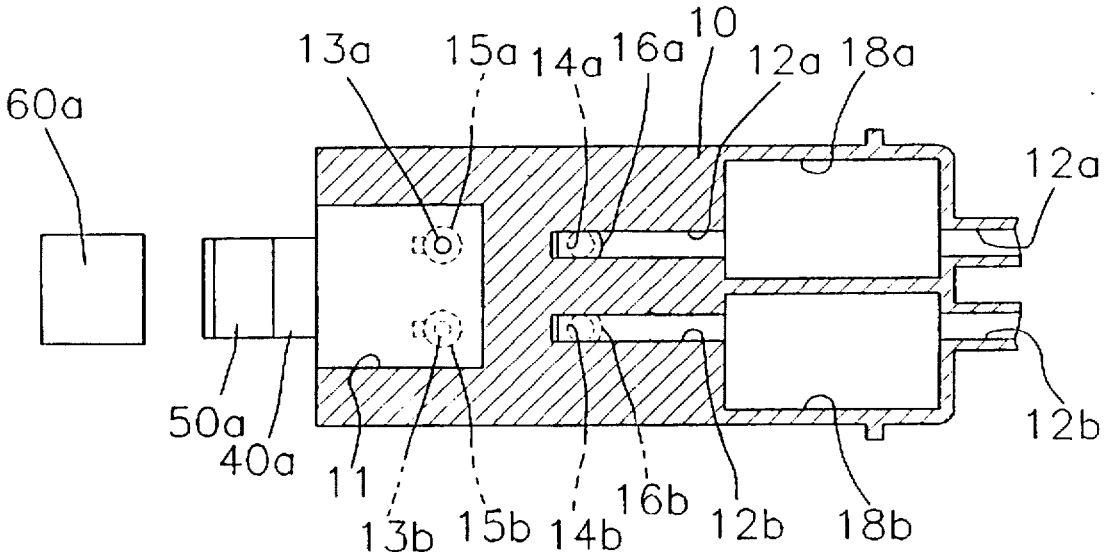
FIG. 6 is a sectional view taken along line B—B in FIG. 5.
Figure 7:
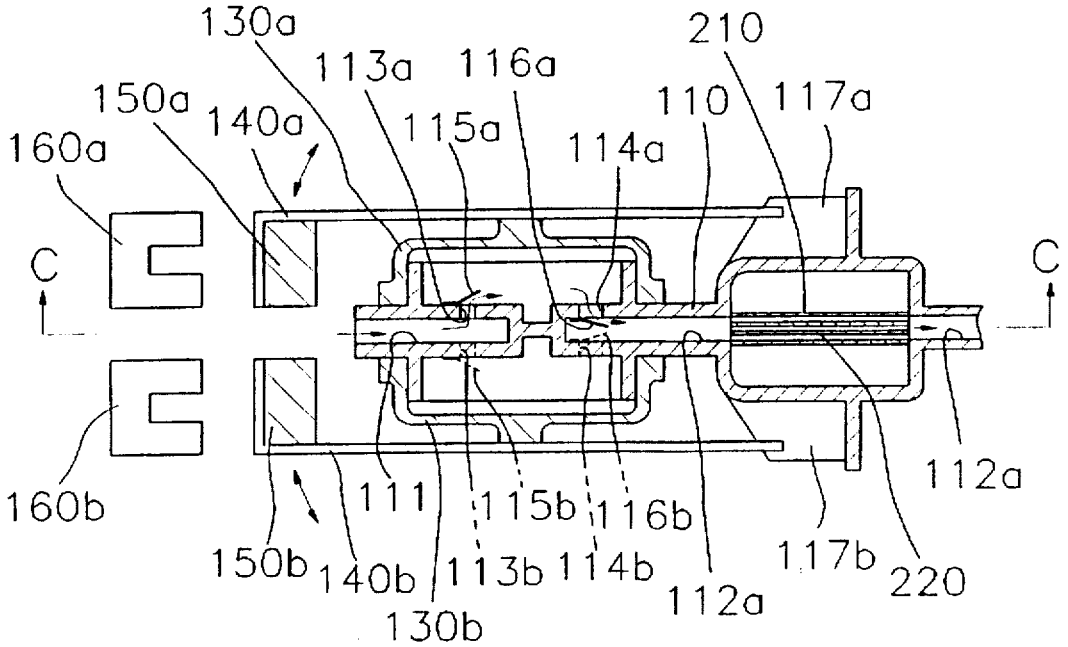
FIG. 7 is a front sectional view of a first embodiment of a bubble generator for a washing machine according to the present invention.
Figure 8:
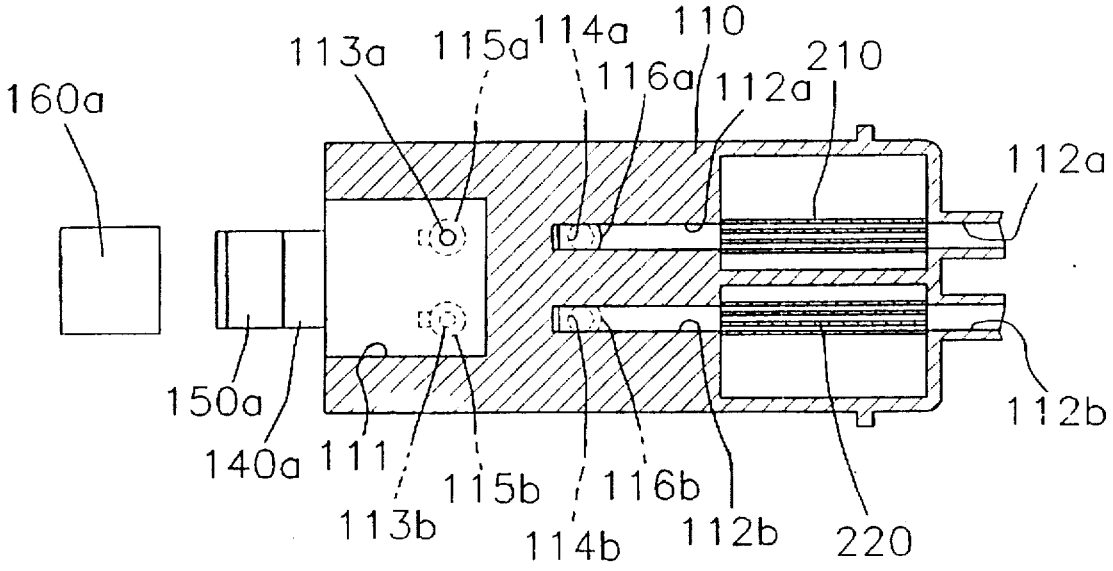
FIG. 8 is a sectional view taken along line C—C in FIG. 7.
Figure 9:
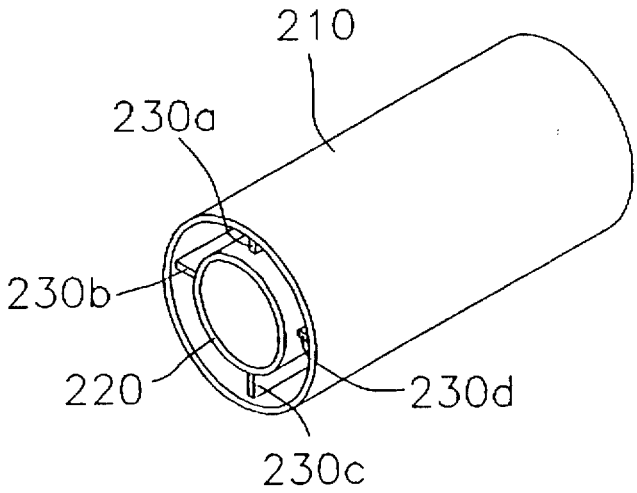
FIG. 9 is a perspective view of a noise-reducing means of the first embodiment of the bubble generator for a washing machine according to the present invention.
Figure 10:
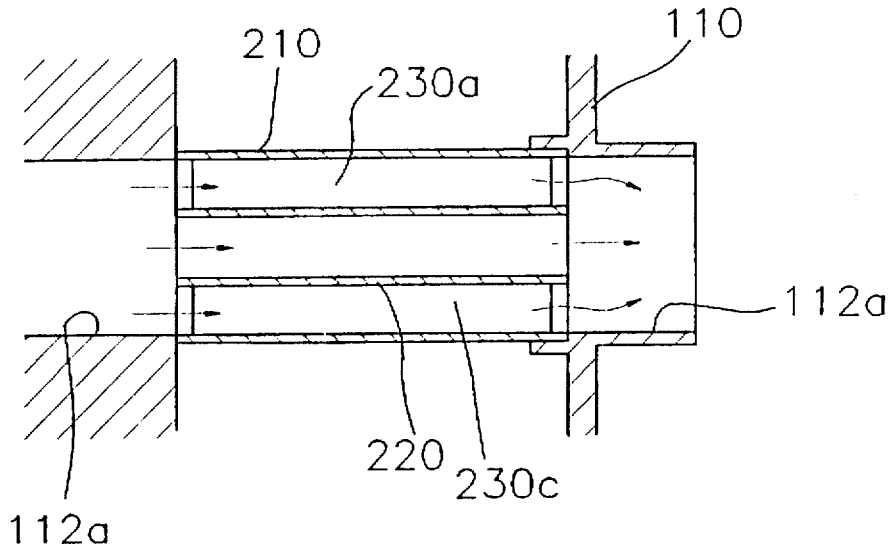
FIG. 10 is a sectional view of the noise-reducing means of the first embodiment of the bubble generator for a washing machine according to the present invention.

FIGS. 7 to 12 illustrate a first embodiment of a bubble generator for a washing machine according to the present invention.

According to FIGS. 7 to 12, the bubble generator for a washing machine according to the present invention includes a body 110, a pumping means and a pair of noise-reducing means.

An inlet passage 111 and outlet passages 112*a* and 112*b* are formed in body 110. First through holes 113*a* and 113*b* are formed at upper and lower sides of one end of inlet passage 111 of body 110, and second through holes 114*a* and 114*b* are formed at upper and lower sides of each end of outlet passages 112*a* and 112*b* of body 110. Brackets 117*a* and 117*b* are respectively provided for upper and lower sides of body 110 near outlet passages 112*a* and 112*b*.

The pumping means includes bellows 130*a* and 130*b*, first check plates 115*a* and 115*b*, second check plates 116*a* and 116*b* and vibration-generating means. The vibration-generating means includes operation plates 140*a* and 140*b*, permanent magnets 150*a* and 150*b* and electromagnets 160*a* and 160*b*.

Bellows 130*a* and 130*b* are respectively attached to upper and lower sides of body 110 to keep air from leaking between outer surface of body 110 and bellows 130*a* and 130*b*. Inlet passage 111 is communicated with insides of bellows 130*a* and 130*b* through first through holes 113*a* and 113*b*, and outlet passages 112*a* and 112*b* are also respectively communicated with the insides of bellows 130*a* and 130*b* through second through holes 114*a* and 114. First through holes 113*a* and 113*b* are open and shut by first check plates 115*a* and 115*b* attached to outer surface of the body 110, and second through holes 114*a* and 114*b* are also open and shut by second check plates 116*a* and 116*b* attached to inner surfaces of outlet passages 112*a* and 112*b* of body 110.

Each of the ends of operation plates 140*a* and 140*b* usually made of resilient materials are respectively mounted on brackets 117*a* and 117*b*, and permanent magnets 150*a* and 150*b* are provided for each of the other ends of operation plates 140*a* and 140*b*. Electromagnets 160*a* and 160*b* are disposed respectively spaced apart from permanent magnets 150*a* and 150*b*. Electromagnets 160*a* and 160*b* and permanent magnets 150*a* and 150*b* are disposed with respect to one another in such a manner that permanent magnets 150*a* and 150*b* move in opposite directions with respect to each other when electromagnets 160*a* and 160*b* are magnetized. That is, electromagnets 160*a* and 160*b* and permanent magnets 150*a* and 150*b* are disposed with respect to one another in such a manner that permanent magnets 150*a* and 150*b* respectively move in directions indicated by arrows in FIG. 11 when electromagnets 160*a* and 160*b* are charged with electric currents of "+" direction and that permanent magnets 150*a* and 150*b* respectively move in directions indicated by arrows in FIG. 12 when electromagnets 160*a* and 160*b* are charged with electric currents of "–" direction.

Bellows 130*a* and 130*b* are respectively attached around the centers of operation plates 140*a* and 140*b*.

The noise-reducing means respectively includes a first pipe 210, a second pipe 220, and a plurality of ribs 230*a*, 230*b*, 230*c* and 230*d*.

First pipes 210 are disposed in the middle of outlet passages 112*a* and 112*b*, and have respectively the same inner diameters as those of outlet passages 112*a* and 112*b*. Second pipes 220 are respectively disposed concentrically with and in first pipes 210 and supported by a plurality of ribs 230*a*, 230*b*, 230*c*, and 230*d* in first pipes 210.

According to the first embodiment of the bubble generator for a washing machine of the present invention constructed as above, when electromagnets 160*a* and 160*b* are charged with alternating currents, permanent magnets 150*a* and 150*b* vibrate in directions opposite to each other by electromagnetic interactions between electromagnets 160*a* and 160*b* and permanent magnets 150*a* and 150*b*. That is, when electromagnets 160*a* and 160*b* are charged with currents of "+" direction, the permanent magnets 150*a* and 150*b* respectively move in directions indicated by the arrows in FIG. 11 and when electromagnets 160*a* and 160*b* are charged with currents of "–" direction, the permanent magnets 150*a* and 150*b* respectively move in directions indicated by the arrows in FIG. 12.

Figure 11:
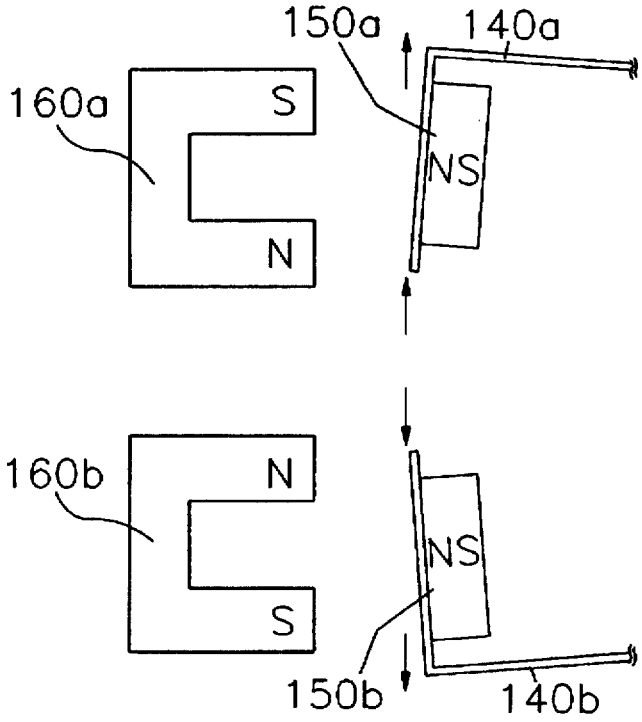
FIG. 11 is a view for explaining polarities of electromagnets and moving directions of permanent magnets when the electromagnets of the bubble generator for a washing machine according to the present invention are charged with electric currents of "+" direction.

If electromagnets 160*a* and 160*b* are charged with currents of "+" direction and permanent magnets 150*a* and 150*b* respectively move in directions indicated by the arrows in FIG. 11, operation plates 140*a* and 140*b* move away from body 110, and accordingly bellows 130*a* and 130*b* respectively attached around the centers of operation plates 140*a* and 140*b* are expanded. If bellows 130*a* and 130*b* are expanded, air pressure inside bellows 130*a* and 130*b* becomes lower than that inside inlet passage 111 and outlet passages 112*a* and 112*b*, so there occurs pressure differences between insides of bellows 130*a* and 130*b* and insides of inlet passage 111 and outlet passages 112*a* and 112*b*. By these pressure differences, first check plates 115*a* and 115*b* which are attached to outer surface of body 110 and have been shutting first through holes 113*a* and 113*b* are pushed toward bellows 130*a* and 130*b*, first through holes 113*a* and 113*b* are open, and accordingly air outside the bubble generator, i.e., atmospheric air, flows into the insides of bellows 130*a* and 130*b*. At the same time, by the pressure differences, second check plates 116*a* and 116*b* attached to inner surfaces of outlet passages 112*a* and 112*b* are also pushed toward bellows 130*a* and 130*b*, second through holes 114*a* and 114*b* are shut, and accordingly air inside outlet passages 112*a* and 112*b* is prevented from flowing backward into the insides of the bellows 130*a* and 130*b*.

Figure 12:
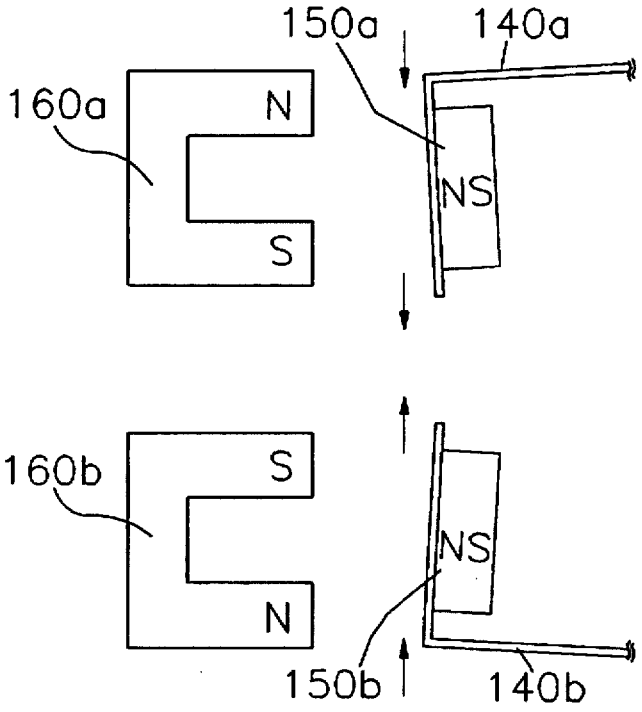
FIG. 12 is a view for explaining polarities of electromagnets and moving directions of permanent magnets when the electromagnets of the bubble generator for a washing machine according to the present invention are charged with electric currents of "–" direction.

Meanwhile, if electromagnets 160*a* and 160*b* are charged with currents of "–" direction with changes of the current direction and permanent magnets 150*a* and 150*b* respectively move in directions indicated by the arrows in FIG. 12, operation plates 140*a* and 140*b* move toward body 110, and accordingly the bellows 130*a* and 130*b* are compressed. If bellows 130*a* and 130*b* are compressed, the air pressure inside the bellows 130*a* and 130*b* becomes higher than that inside inlet passage 111 and outlet passages 112*a* and 112*b*, so there occur pressure differences between the insides of bellows 130*a* and 130*b* and the insides of inlet passage 111 and outlet passages 112*a* and 112*b*. By these pressure differences, first check plates 115*a* and 115*b* are pushed toward body 110, first through holes 113*a* and 113*b* are shut, and accordingly air inside bellows 130*a* and 130*b* is prevented from flowing backward into inlet passage 111. At the same time, by the pressure differences, second through holes 114*a* and 114*b* which have been shut by second check plates 116*a* and 116*b* are also open, and accordingly air inside bellows 130*a* and 130*b* is delivered with pressure into outlet passages 112*a* and 112*b*.

The pressurized air that flows into outlet passages 112*a* and 112*b* flows through flow passages divided into several sections by the first pipes 210, the second pipes 220 and a plurality of ribs 230*a*, 230*b*, 230*c* and 230*d* of the noise-reducing means. The pressurized air that flows into the noise-reducing means expands inside the respective section of the flow passages.

The pressurized air discharged through the noise-reducing means is supplied into a washing tub (not shown) through bubble-supply lines which are not shown.

A series of such operation is continuously repeated as the directions of the alternating currents flowing through electromagnets 160*a* and 160*b* change, and according to this, air-bubbles are continuously supplied to the washing tub.

Therefore, according to the first embodiment of the bubble generator for a washing machine of the present invention, since the pressurized air that has been discharged into the outlet passages 112*a* and 112*b* expands inside the respective section of the flow passages of the noise-reducing means, noises generated by the bubble generator can be considerably reduced compared with the prior-art bubble generators in which the air that flows into the outlet passages entirely expands only in the outlet passages.

Figure 13:
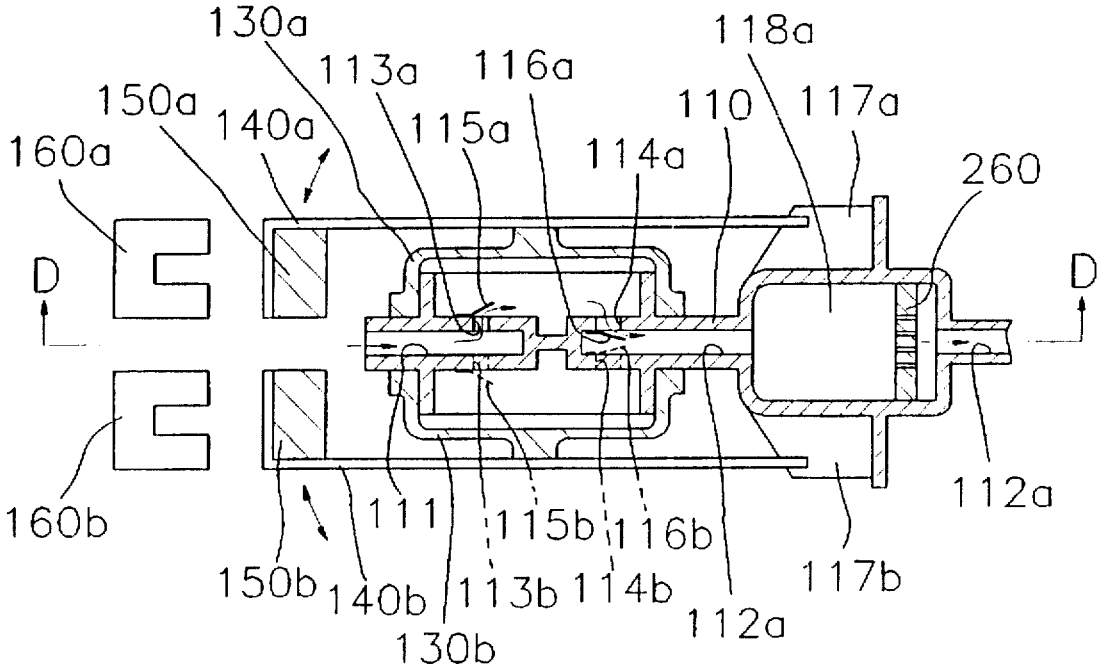
FIG. 13 is a front sectional view of a second embodiment of the bubble generator for a washing machine according to the present invention.
Figure 14:
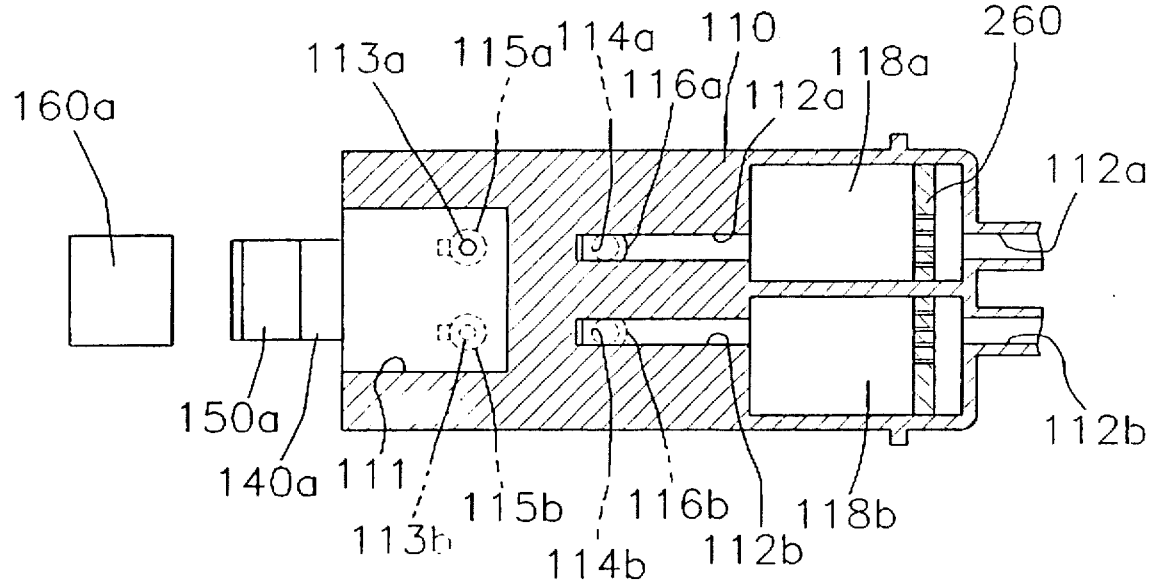
FIG. 14 is a sectional view taken along line D—D in FIG. 13.
Figure 15:
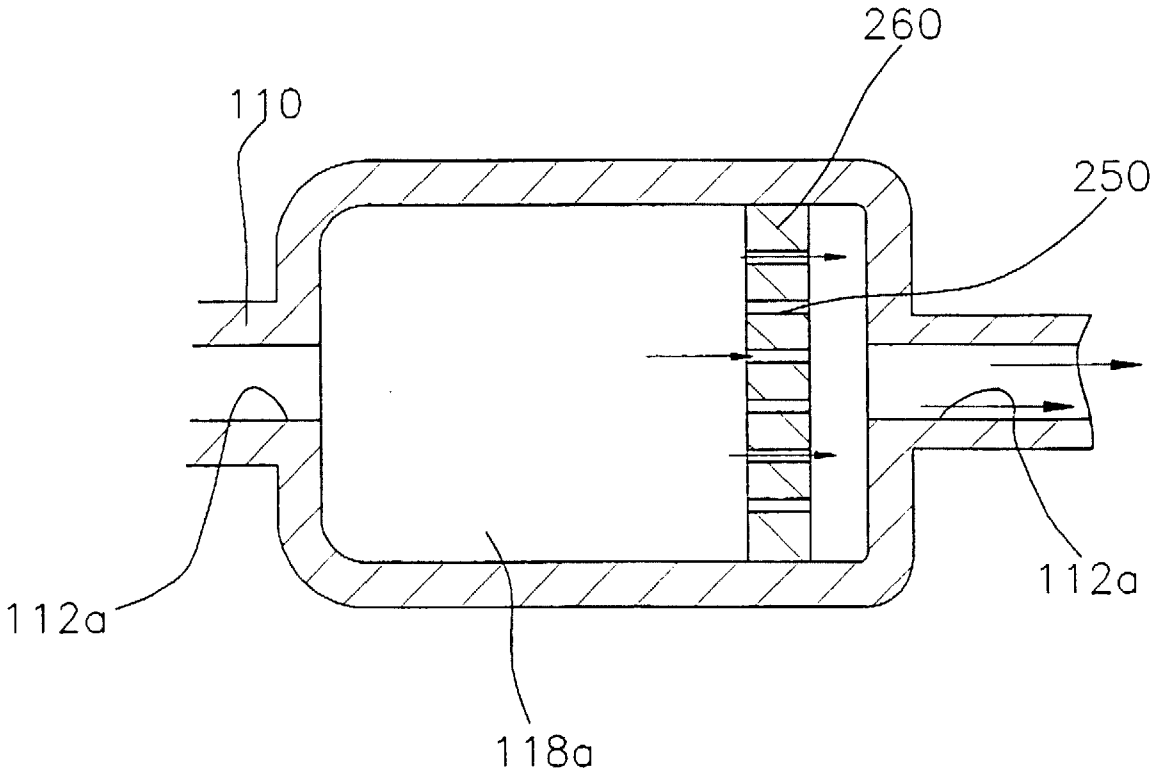
FIG. 15 is a sectional view of a noise-reducing means of the second embodiment of the bubble generator for a washing machine according to the present invention.

FIGS. 13 to 15 illustrate a second embodiment of the bubble generator for a washing machine according to the present invention.

According to FIGS. 13 to 15, the construction of the second embodiment of the bubble generator for a washing machine is, as explicitly shown in the drawings, entirely identical to that of the bubble generator according to the first embodiment, except that, in the second embodiment of the bubble generator, noise-reducing means includes expansion chambers 118*a* and 118*b* formed in the middle of outlet passages 112*a* and 112*b* and sound-absorbing plates 260 being disposed in expansion chambers 118*a* and 118*b*, having a plurality of through holes 250 and made of sound-absorbing materials, while, in the first embodiment of the bubble generator, the noise-reducing means includes first pipes 210, second pipes 220, and a plurality of ribs 230*a*, 230*b*, 230*c* and 230*d*. Therefore, the applicant gives the same reference numbers to the corresponding parts of the second embodiment of the bubble generator of the present invention with those of the first embodiment of the bubble generator of the present invention and omits descriptions as to the construction of the second embodiment.

According to the second embodiment of the bubble generator for a washing machine of the present invention constructed as above, the pressurized air that has been discharged through second through holes 114*a* and 114*b* into outlet passages 112*a* and 112*b* by the pumping means firstly expands in expansion chambers 118*a* and 118*b* provided in the middle of outlet passages 112*a* and 112*b* and thereafter disperses through a plurality of through holes 250 formed in sound-absorbing plates 260 made of sound-absorbing materials and provided inside expansion chambers 118*a* and 118*b*.

Therefore, according to the second embodiment of the bubble generator for a washing machine of the present invention constructed as above, since the pressurized air that has been discharged into outlet passages 112*a* and 112*b* firstly expands inside expansion chambers 118*a* and 118*b* provided in the middle of outlet passages 112*a* and 112*b* and thereafter expands with dispersing through a plurality of through holes 250 formed in sound-absorbing plates 260, noises generated by the bubble generator can be considerably reduced compared with the prior-art bubble generators in which the air that has been flows into the outlet passages entirely expands in the outlet passages or in the outlet passages and the expansion chambers.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A bubble generator for a washing machine, comprising:

a body with an inlet passage and outlet passages;

pumping means disposed between the inlet passage and the outlet passages for pressurizing air that flows through the inlet passage into the pumping means and discharges it through the outlet passages; and noise-reducing means disposed in the middle of the outlet passages, for reducing noises caused by the pressurized air which is periodically pressurized by the pumping means and discharged into the outlet passages, by dispersing the pressurized air inside the outlet passages, said noise-reducing means comprising:

a first pipe having the same inner diameter as that of the outlet passage;

a second pipe disposed concentrically with and in the first pipe; and a plurality of ribs supporting the second pipe at the first pipe.

2. A bubble generator for a washing machine as claimed in claim 1, wherein the pumping means comprises:

a plurality of bellows the insides of which are communicated with the inlet passage through first through holes formed at one end of the inlet passage of the body and are also communicated with the outlet passages through second through holes formed at each of the ends of the outlet passages;

one or more first check plates attached to an outer surface of the body for opening and shutting the first through holes as the bellows are expanded and contracted;

one or more second check plates attached to inner surfaces of the outlet passages of the body for shutting and opening the second through holes as the bellows are expanded and contracted; and a vibration-generating means with a plurality of permanent magnets and a plurality of electromagnets for periodically expanding and contracting the bellows as the electromagnets are charged with alternating currents.

* * * * *